United States Patent [19]

English et al.

[11] 4,315,786

[45] Feb. 16, 1982

[54] SOLID PROPELLANT HYDROGEN GENERATOR

[75] Inventors: William D. English, Orange; William M. Chew, Yorba Linda, both of Calif.

[73] Assignee: TRW Inc., Redondo Beach, Calif.

[21] Appl. No.: 162,551

[22] Filed: Jun. 24, 1980

[51] Int. Cl.[3] ..... C06B 43/00

[52] U.S. Cl. ..... 149/22; 149/108.2; 423/648 R

[58] Field of Search ..... 149/22, 37, 108.2; 423/648 R

[56] References Cited

U.S. PATENT DOCUMENTS

| | | | |
|---|---|---|---|
| 3,322,515 | 5/1967 | Dittrich et al. | 149/108.2 |
| 3,690,849 | 9/1972 | Bredzs et al. | 149/22 |
| 3,695,951 | 10/1972 | Helms et al. | 149/37 |
| 3,948,699 | 4/1976 | Ayers et al. | 149/22 |
| 4,061,512 | 12/1977 | Chew et al. | 149/22 |
| 4,157,927 | 6/1979 | Chew et al. | 149/22 |
| 4,166,843 | 9/1979 | Flanagan | 149/22 |

*Primary Examiner*—Edward A. Miller

*Attorney, Agent, or Firm*—Donald R. Nyhagen; Robert W. Keller

[57] ABSTRACT

A mixture of at least two particulate metals capable of undergoing an exothermic reaction to form an intermetallic compound is provided to sustain decomposition of borane reactants to yield hydrogen or deuterium.

11 Claims, No Drawings

SOLID PROPELLANT HYDROGEN GENERATOR

BACKGROUND OF THE INVENTION

In recent years, significant developments have been made in high-energy chemical lasers.

In addition to the non-consumable laser hardware itself, advances have been made in consumable sub-system technology. A fieldable, high-energy chemical laser device requires a disposable oxidizer, fuel, and pumping systems so that logistics do not become unmanageable. The chemical pump has advanced through practical demonstration tests, and solid oxidizers have already been demonstrated. The chemical pump is based on an activated calcium material, isostatically pressed as internally tapered angular discs, which react with the laser effluent, producing non-volatile products. Solid oxidizer work has focused on $NF_4$ salt technology and has resulted in the development of the $NF_4BF_4$ combustor. Formulations of $NF_4BF_4$, when combusted, yield 30% weight-by-weight $NF_3+F_2$ laser reactants and a solid residue.

High-energy chemical lasers require hydrogen and/or deuterium as pre-combustor and cavity fuels. Although available from high-pressure gaseous supply systems, they present severe logistic and safety problems. Solid fuel generators, for the production of hydrogen and/or deuterium, are needed.

Hydrogen generators employing mixtures of lithium aluminum hydride and ammonium chloride have been proposed. Although the formulations provide pure hydrogen, the residue undesirably contains lithium hydride, an active species. Mixtures of sodium tetrahydroborate and iron oxide have also been proposed. Although producing pure hydrogen and an inert residue, hydrogen yield is only about 2.8% weight-by-weight, which is insufficient for practical application.

Compositions based on ammonium salt-sodium tetraborate have also been developed, but have been found to produce significant quantities of ammonia, a laser deactivator, and exhibit a maximum yield of 5.5% weight-by-weight hydrogen.

In U.S. Pat. No. 4,157,927, incorporated herein by reference, in which one of us is a named inventor, there is disclosed the use of amine-boranes and their derivatives as solid propellants to generate hydrogen or deuterium upon combustion. It is disclosed that functional compositions can be formulated by blending amine-borane or its derivatives with heat-producing compounds, such as $LiAlH_4$, or a mixture such as $NaBH_4/Fe_2O_3$. It was proposed that the resulting mixture be pressed into pellets and ignited to produce hydrogen (or deuterium if the analagous per-deutero reactants are substituted for the hydride ones specified), and by-products that are non-deactivating diluents. It was found, however, that when, as discussed in the patent, ammonia-borane was combined with $NaBH_4/Fe_2O_3$, intimately mixed and pressed into a pellet, a strong odor was detected emanating from the pellet, indicating that the pellet was thermally unstable at ambient temperature.

SUMMARY OF THE INVENTION

According to the present invention, there is provided a solid composition capable of producing hydrogen or deuterium, which comprises at least one borane reactant capable of yielding hydrogen or deuterium on decomposition in combination with a metallic reactant comprising at least two particulate metals capable of entering into an exothermic reaction forming an intermetallic compound. The metallic reactant is present in a quantity sufficient to initiate and sustain, on reaction, essentially complete decomposition of said borane reactant. This combination is preferably provided as an intimate admixture in pelletized form. The presently preferred borane reactants are monoboranes containing one boron atom per molecule, and the preferable borane reactant is ammonia borane. The presently preferred metallic reactant is a particulate mixture of aluminum and nickel in molar proportions of 3 moles of aluminum per mole of nickel.

DETAILED DESCRIPTION OF THE INVENTION

According to the present invention, there is provided a solid composition capable of producing hydrogen or deuterium, and based on the combination of a borane reactant, and a metallic reactant comprised of at least two particulate metals capable of entering into an exothermic reaction leading to the formation of an intermetallic compound. The metallic reactant is present in a quantity sufficient that upon reaction of the metals, it will provide a quantity of heat sufficient to initiate and sustain, during reaction, essentially complete decomposition of the borane reactant to yield hydrogen or deuterium.

By a borane reactant there is meant compounds containing the substituted or unsubstituted group $H_3B$, in which boron is positive and hydrogen is negative or hydridic, or $D_3B$, in which, again, boron is positive and the deuterium ion is negative or deutridic. A particulate class of compounds is known as the amine-boranes or their derivatives. These compounds have the generalized formula $B_xN_xH_y$ or $B_xN_xD_y$, and have the potential of giving up their hydrogen or deuterium end yield xBN and $(y/2)H_2$ or $(y/2)D_2$.

The simplest stable compound is ammonia borane ($H_3BNH_3$). Another useful compound is diammoniate of diborane $[H_2B(NH_3)]_2[BH_4]$. The diammoniate of diborane will lose hydrogen to form the polymer $(H_2BNH_2)_x$, and if heated still more strongly, will yield borazole ($B_3N_3H_6$), a compound analogous to benzene in structure. Temperatures greater than about 900° C. are required for maximum hydrogen yield. Ammonia borane is presently preferred, and may be prepared by reacting dimethyl ether borane with liquid ammonia. Other compounds which may be mentioned as having utility include hydrazine bis borane ($N_2H_4.2BH_3$); hydrazinium bis tetrahydridoborate $[N_2H_6(BH_4)_2]$; derivatives of the amine-borane such as compounds of the formula $H_2B(NH_3)_2X$, wherein X is halogen; metal complexes such as $Cr(NH_3)_6BH_4$ and the like. Where deuterium is the desired product, each compound where hydrogen is present is substituted by deuterium. The borane reactants useful in this invention are characterized as compounds which are difficult to self-decompose and which decompose to give, besides hydrogen or deuterium, an inert residue. An example is ammonia borane which presents the difficulty of having a strong endotherm somewhere in the temperature range of about 80° to about 100° C.

In accordance with the invention, there is provided a particulate metal reactant comprised of at least two metals which undergo an exothermic reaction to form an intermetallic compound in quantity to sustain decomposition, i.e. total dehydration or dedeuterization, of the borane reactant and satisfy all other heat requirements of the system. Without being limiting, Table I below lists a number of desired intermetallic compounds and their heats of formation. To facilitate reaction, the particles are in a finely divided state, preferably 50 microns or less.

TABLE I

| Intermetallic Product AxBy | Relative % by Weight A | B | Heat of Formation ΔH/at 25° C. Kcal/Mol | cal/g |
|---|---|---|---|---|
| $Li_2Se$ | 1 | 5.6 | −85 | −916 |
| $Na_2Se$ | 1 | 1.7 | −82 | −657 |
| CaSe | 1 | 2.0 | −75 | −628 |
| CaSi | 1 | 0.7 | −36 | −529 |
| $K_2Se$ | 1 | 1.0 | −74 | −505 |
| SrSe | 1 | 0.9 | −83 | −499 |
| $Al_2Ni$ | 1 | 0.73 | −68 | −487 |
| $Na_2Te$ | 1 | 2.8 | −84 | −487 |
| $Ca_3Sb_2$ | 1 | 2.0 | −174 | −479 |
| $Ca_2Si$ | 1 | 0.35 | −50 | −461 |
| SiTi | 1 | 1.7 | −31 | −408 |

The presently preferred metallic compound is nickel trialuminate ($Al_3Ni$). When considered with amine-borane, the reactive portion of the system may be characterized as undergoing the following change upon ignition:

$$3Al + Ni \longrightarrow Al_3Ni + Heat$$

$$NH_3BH_3 \xrightarrow{(Heat)} BN + 6H_2$$

Ignition is of the metals which undergo the exothermic intermetallic forming reaction, and is initiated by a hot wire, squib, or the like igniters. It is preferred that the metals be provided in proportions stoichiometric to the intermetallic compound to be formed. An excess of one metal over the other may be present but is benign, although it can functionally act as a distributor of heat. While it is presently preferred to blend the desired quantity of the particulate metals with the borane compound and pelletize the mix, it is also feasible to form separate pellets of the metallic reactant and the borane compound. To be avoided in the system are materials which consume at the temperatures of the decomposition the hydrogen or deuterium which is the product of thermal decomposition.

EXAMPLE

A mixture consisting of six parts by weight of one-micron fine nickel metal and ten parts by weight of ten-micron fine aluminum metal was prepared and blended by tumbling for one hour. A composite consisting of 3.06 parts by weight of ammonia borane and 0.88 part by weight of the nickel aluminum blend was blended by tumbling for one hour. A pellet was pressed from 1.48 parts by weight of the composite mixture and was placed in a Parr type reactor and ignited with an ignition heating wire (20-gauge Kenthal A-1) wrapped around the pellet and connected to electrical leads. The reactor was sealed. The reaction yielded about 100% of the theoretical quantity of hydrogen present.

Control

A pellet formed only of ammonia borane was tested under the same conditions. The pellet did not react and no hydrogen was generated.

We claim:

1. A solid composition capable of producing hydrogen or deuterium which comprises, in combination, at least one borane reactant containing bound hydrogen or deuterium and a metallic reactant comprised of at least two particulate metals capable of entering into an exothermic reaction to form an intermetallic compound, said metallic reactant being present in a quantity sufficient to initiate and sustain, on reaction to form the intermetallic compound, simultaneous decomposition of said borane reactant to yield hydrogen or deuterium.

2. A solid composition as claimed in claim 1 in which the borane reactant is ammonia borane.

3. A solid composition as claimed in claim 1 in which the metallic reactant is an admixture of particulate aluminum and particulate nickel in which the molar ratio of aluminum to nickel is about 3 to 1.

4. A solid composition as claimed in claim 2 in which the metallic reactant is an admixture of particulate aluminum and particulate nickel in which the molar ratio of aluminum to nickel is about 3 to 1.

5. A composition as claimed in claim 4 in which the weight ratio of ammonia borane to the metallic reactant is at least about 3.5.

6. A pellet capable of producing hydrogen or deuterium which comprises a compressed admixture of at least one borane reactant containing bound hydrogen or deuterium and a metallic reactant comprised of at least two particulate metals capable of entering into an exothermic reaction forming an intermetallic compound, said metallic reactant being present in a quantity sufficient to initiate and sustain, on reaction to form the intermetallic compound, simultaneous decomposition of said borane reactant to yield hydrogen or deuterium.

7. A pellet as claimed in claim 6 in which the borane reactant is a monoborane compound.

8. A pellet as claimed in claim 6 in which the borane reactant is ammonia borane.

9. A pellet as claimed in claim 6 in which the metallic reactant is an admixture of particulate aluminum and particulate nickel in which the molar ratio of aluminum to nickel is about 3 to 1.

10. A pellet as claimed in claim 8 in which the metallic reactant is an admixture of particulate aluminum and particulate nickel in which the molar ratio of aluminum to nickel is about 3 to 1.

11. A pellet as claimed in claim 10 in which the weight ratio of ammonia borane to the metallic reactant is at least about 3.5.

* * * * *